US010415248B2

(12) United States Patent
Humphreys et al.

(10) Patent No.: US 10,415,248 B2
(45) Date of Patent: Sep. 17, 2019

(54) SHINGLE WITH HEADLAP MASK

(71) Applicant: TAMKO Building Products, Inc., Joplin, MO (US)

(72) Inventors: David C. Humphreys, Joplin, MO (US); Thomas M. King, Carthage, MO (US); Rodney Lewis, Joplin, MO (US)

(73) Assignee: TAMKO Building Products LLC, Joplin, MO (US)

( * ) Notice: Subject to any disclaimer, the term of this patent is extended or adjusted under 35 U.S.C. 154(b) by 582 days.

(21) Appl. No.: 14/203,877

(22) Filed: Mar. 11, 2014

(65) Prior Publication Data

US 2014/0259820 A1 Sep. 18, 2014

Related U.S. Application Data

(60) Provisional application No. 61/794,624, filed on Mar. 15, 2013.

(51) Int. Cl.

| | |
|---|---|
| ***E04B 1/26*** | (2006.01) |
| ***E04D 1/26*** | (2006.01) |
| ***G09F 3/02*** | (2006.01) |
| ***G09F 19/22*** | (2006.01) |

(52) U.S. Cl.

CPC ..... *E04D 1/26* (2013.01); *G09F 3/02* (2013.01); *G09F 19/22* (2013.01); *Y10T 428/24372* (2015.01)

(58) Field of Classification Search

CPC ..... E04D 1/26

See application file for complete search history.

(56) References Cited

U.S. PATENT DOCUMENTS

| | | | | |
|---|---|---|---|---|
| 5,951,809 | A * | 9/1999 | Jenkins | E04D 1/26 156/247 |
| 6,237,288 | B1 | 5/2001 | Jenkins et al. | |
| 6,253,512 | B1 * | 7/2001 | Thompson | E04D 1/14 52/311.1 |
| 6,920,730 | B2 | 7/2005 | Becker et al. | |
| 7,776,391 | B2 | 8/2010 | Teng et al. | |
| 7,805,905 | B2 | 10/2010 | Rodrigues et al. | |
| 7,836,654 | B2 | 11/2010 | Belt et al. | |
| 7,971,406 | B2 | 7/2011 | Kalkanoglu | |
| 8,156,704 | B2 | 4/2012 | Belt et al. | |
| 8,240,100 | B2 | 8/2012 | Kalkanoglu et al. | |
| 8,240,102 | B2 | 8/2012 | Belt et al. | |
| 8,281,539 | B2 | 10/2012 | Kalkanoglu | |
| 8,302,358 | B2 | 11/2012 | Kalkanoglu | |

(Continued)

*Primary Examiner* — William P Watkins, III

(74) *Attorney, Agent, or Firm* — Husch Blackwell LLP

(57) ABSTRACT

A roofing shingle comprising a base mat having a tab portion covered with granules and a headlap portion covered with a mask or film layer. An asphalt-based coating is applied to at least a top surface of the base mat. The film layer is adhered to the asphalt-based coating applied to the headlap portion and the granules are adhered to the asphalt-based coating applied to the tab portion. The film layer is adapted for preventing granules from adhering to the headlap portion of the base mat and, as such, the headlap portion may be substantially free from any granules adhered thereto. A method for manufacturing a roofing shingle is also provided wherein granules that are not adhered to the tab portion of one shingle may be collected and reapplied the tab portion of another shingle.

6 Claims, 3 Drawing Sheets

(56) References Cited

U.S. PATENT DOCUMENTS

| | | | | |
|---|---|---|---|---|
| 8,309,169 | B2 | 11/2012 | Teng et al. | |
| 8,371,085 | B2 | 2/2013 | Koch | |
| 2007/0044410 | A1 | 3/2007 | Kalkanoglu | |
| 2009/0282767 | A1 | 11/2009 | Grubka | |
| 2011/0151170 | A1 | 6/2011 | Grubka et al. | |
| 2011/0197534 | A1* | 8/2011 | Belt | E04D 1/26 52/520 |
| 2012/0174517 | A1 | 7/2012 | Jenkins | |
| 2012/0227347 | A1 | 9/2012 | Kalkanoglu et al. | |
| 2012/0260597 | A1 | 10/2012 | Jenkins et al. | |
| 2013/0000240 | A1 | 1/2013 | Kalkanoglu | |
| 2013/0025224 | A1 | 1/2013 | Vermilion et al. | |
| 2013/0025768 | A1 | 1/2013 | Vermilion et al. | |
| 2013/0177728 | A1 | 7/2013 | Grubka et al. | |

* cited by examiner

SHINGLE WITH HEADLAP MASK

CROSS-REFERENCE TO RELATED APPLICATIONS

This application claims priority to U.S. Provisional Patent Application Ser. No. 61/794,624, filed on Mar. 15, 2013, to David C. Humphreys et al. entitled "Asphalt Shingle with Head-Lap Mask,", the entire disclosure of which is incorporated herein by reference.

FIELD OF THE INVENTION

The present invention relates generally to an asphalt roofing shingle or product having a mask or film applied over a headlap portion such that granules do not adhere to the headlap portion during the manufacturing process. The present invention also relates generally to a method of manufacturing a shingle wherein at least a portion of the granules not adhered to the headlap portion of one shingle may be collected and reapplied to the headlap portion of another shingle.

BACKGROUND OF THE INVENTION

Typical asphalt-based roofing shingles include a base mat that is impregnated with asphalt and covered with a layer of ceramic granules. To provide an aesthetic appearance, a blend of colored granules is applied to the exposed tab portions of the shingles, which are visible when the shingles are installed on a roof. However, in an effort to reduce cost, granules of a single color or granules of a lesser quality are applied to the headlap portions of the shingles, which are normally covered when the shingles are installed on a roof. Because the headlap portion is not exposed or visible upon installation, the use of granules of a single color or lesser quality has no impact on the appearance or performance of the shingle.

The use of different types of granules on the tab portion and headlap portion results in waste. When the blend of colored granules is applied to the tab portion, not all of the granules are adhered to the shingle. Instead, a portion of these granules do not become adhered to the shingle and fall below. The same is true for the granules that are applied to the headlap portion. Due to the close spatial proximity in which the more costly tab granules and less costly headlap portion granules are applied to the shingle, all of the granules which do not adhere to the shingle fall to a common area below and become mixed. While this mix of backfall granules can be reused, because the headlap granules are mixed in with the tab granules, the recovered granules cannot be reapplied to the tab portion. To do so would result in tab portions of an inconsistent color and visual appearance. Rather, the recovered backfall granules, which include a mix of the more costly tab granules and the less costly headlap granules, can only be reapplied to the headlap portion. Thus, a percentage of the more costly blended colored granules do not end up on the intended tab portion of the product, but instead end up on the headlap portion. As such, this is viewed as a waste and inefficiency in the production process.

The granules applied to asphalt-based shingles can account for a significant part of the overall weight of the shingles. The heavier the shingles, the more difficult it can be for installers to handle and maneuver bundles of the shingles and the more costly it is to transport the shingles via truck or rail. Further, the heavier the shingles, the greater the possibility that a roof structure may experience a failure due to a snow load or other overloading scenarios.

Accordingly, a need exists for a shingle that does not require separate headlap granules and tab granules so that substantially all of the blended color tab granules that do not initially become adhered to one shingle may be recovered and reapplied to the tab portion of another shingle during the manufacturing process. An additional need exists for an asphalt-based shingle that is lighter in weight. A further need exists for a shingle that can be manufactured on a more cost effective and efficient basis.

SUMMARY OF THE INVENTION

One embodiment of the present invention is directed generally to a roofing shingle comprising a base mat having a tab portion covered with granules and a headlap portion covered with a mask or film layer. An asphalt-based coating may be applied to at least a top surface of the base mat. The granules are adhered to the asphalt-based coating that has been applied to the tab portion. The film layer is adhered to the asphalt-based coating that has been applied to the headlap portion.

The film layer is adapted for preventing granules from adhering to the headlap portion of the base mat and, as such, the headlap portion may be substantially free from any granules adhered thereto. The film layer can be constructed of polyester, polyvinylchloride, polyethylene, polypropylene, vinyl, metallic foil, parchment, paper, combinations thereof or any other material now known or hereafter developed to which the granules will generally not adhere. The film layer may cover substantially the entire headlap portion or less than the entire headlap portion. In one embodiment, the film layer only covers the headlap portion and does not extend onto the tab portion. Additionally, the film layer may include indicia printed or otherwise applied thereto, which may include the manufacturer's name, manufacturing tracking information, installation instructions, product warnings, warranty information, one or more laying lines, one or more guide marks, marketing information, a globally unique identifier (GUID), a quick response (QR) code or a bar code.

Another aspect of the present invention is directed to a method for manufacturing a shingle comprising the steps of coating at least the top surface of the base mat with the asphalt-based coating to form an asphalt-coated sheet having a coated tab portion and headlap portion, applying a film to at least part of the headlap portion, and applying granules to the tab portion. The film is adapted for preventing granules from adhering to the part of said headlap portion to which the film is applied. The method may further comprise the steps of collecting granules that do not become adhered to the tab portion one shingle, introducing such collected granules to a primary source of granules and reapplying the collected granules to the tab portion of another shingle.

Other aspects and advantages of the present invention will be apparent from the following detailed description of the preferred embodiments and the accompanying drawing figures.

DESCRIPTION OF THE SEVERAL VIEWS OF THE DRAWINGS

In the accompanying drawings, which form a part of the specification and are to be read in conjunction therewith in which like reference numerals are used to indicate like or similar parts in the various views.

DETAILED DESCRIPTION OF THE INVENTION

Figure 1:
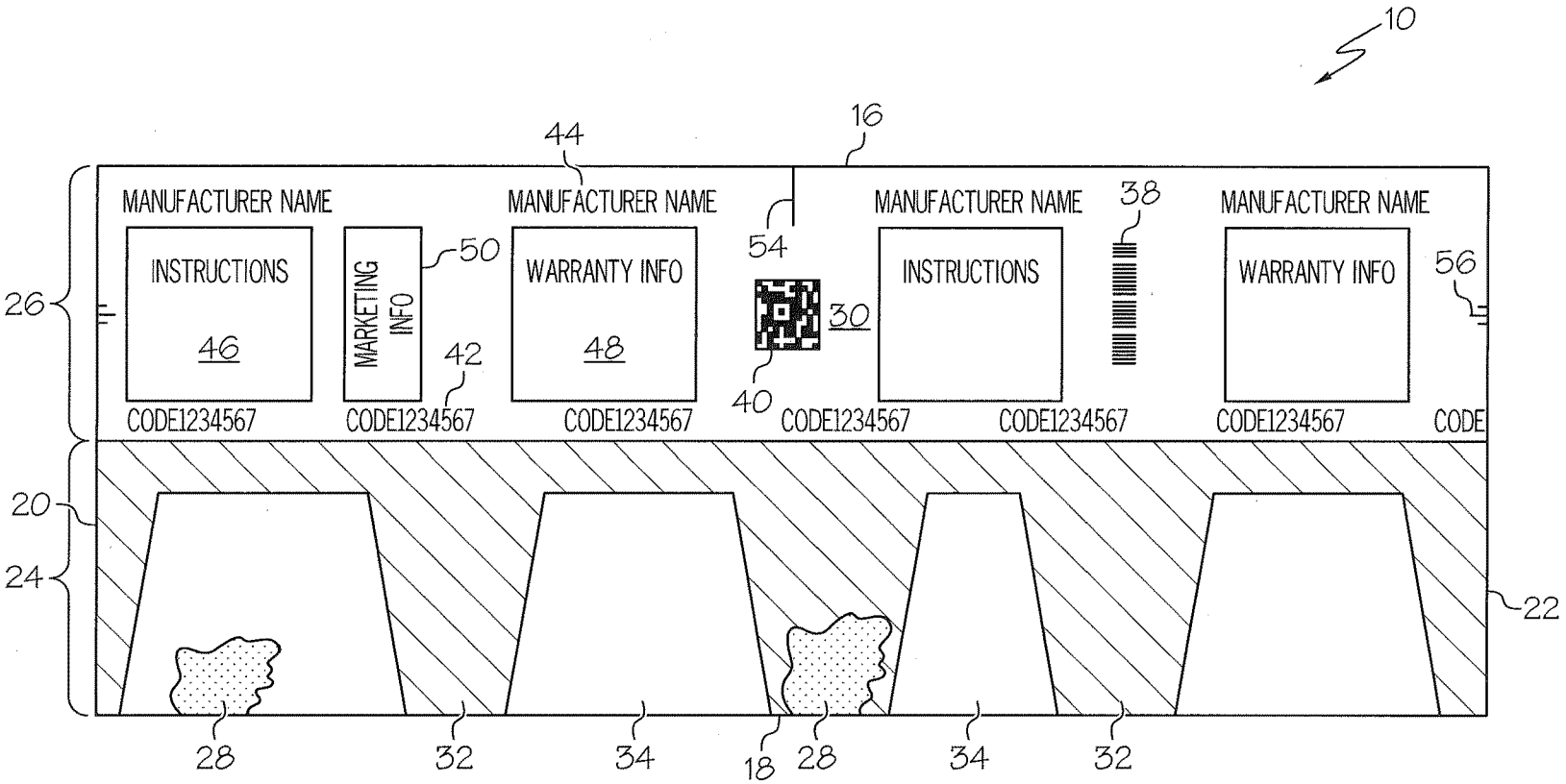
FIG. 1 is a top plan view of a laminated shingle having a headlap mask or film in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

Referring to the figures, the present invention is directed to a shingle 10 that includes a base mat 36 having a top surface 12, a bottom surface 14, an upper end 16, a lower end 18, a first side end 20 and a second side end 22. As further illustrated in FIG. 1, the shingle 10 includes a tab portion 24 and a headlap portion 26. As discussed in greater detail below, the tab portion 24 may be covered with granules 28 while the headlap portion 26 may be covered, in whole or in part, by a mask or film layer 30.

Figure 2:
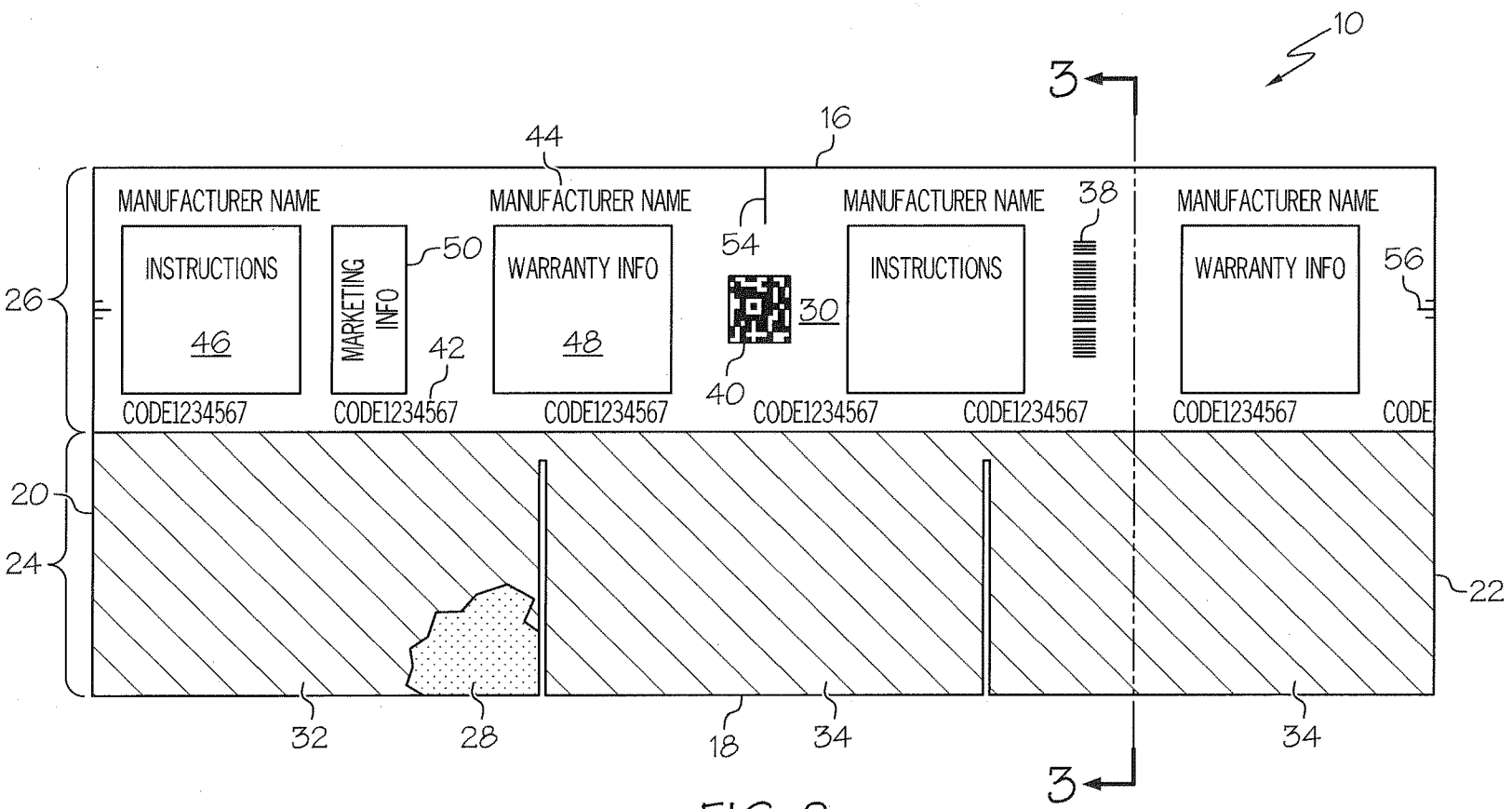
FIG. 2 is a top plan view of a three-tab shingle having a headlap mask or film in accordance with another embodiment of the present invention.

The shingle 10 of the present invention may be a multiple-layer laminated shingle having alternating tabs 32 and cutouts 34 as depicted in FIG. 1, a three-tab shingle as depicted in FIG. 2 or any other suitable shingle or roofing product now known or hereafter developed. In general, the shingle 10 includes a base mat 36 which may be constructed, at least in part, from fiberglass, felt, de-fibered wool, paper or any other suitable material now known or hereafter developed. The base mat 36 can have an asphalt-based or other bitumen material applied thereto. The asphalt-based material may be coated or applied to the top and bottom surfaces 12 and 14 of the base mat 36 such that the base mat 36 becomes generally coated and/or saturated. The asphalt-based coating may optionally include fillers, such as mineral fillers.

Figure 3:
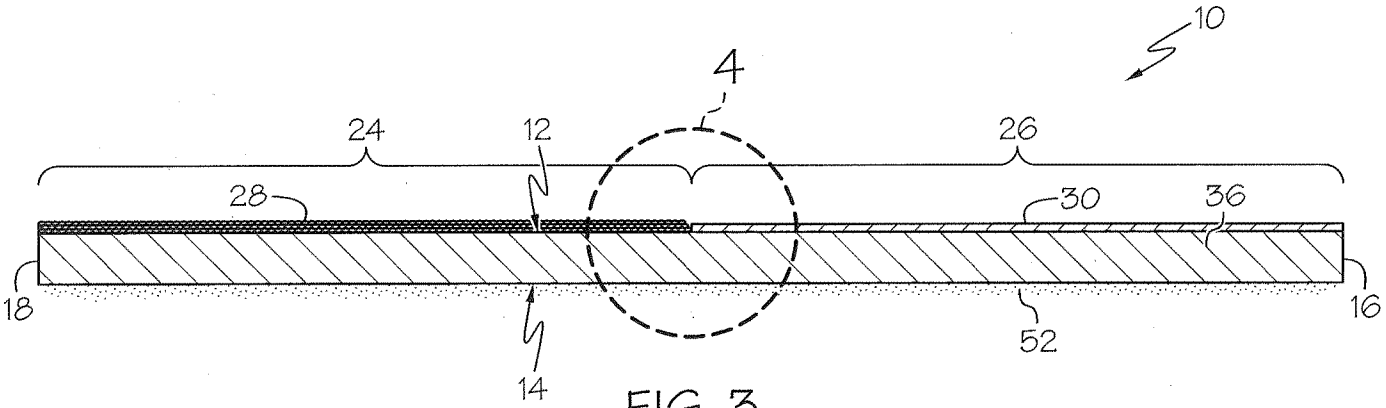
FIG. 3 is a sectional view of the shingle of FIG. 2 taken generally along the line 3-3 in the direction of the arrows.
Figure 4:
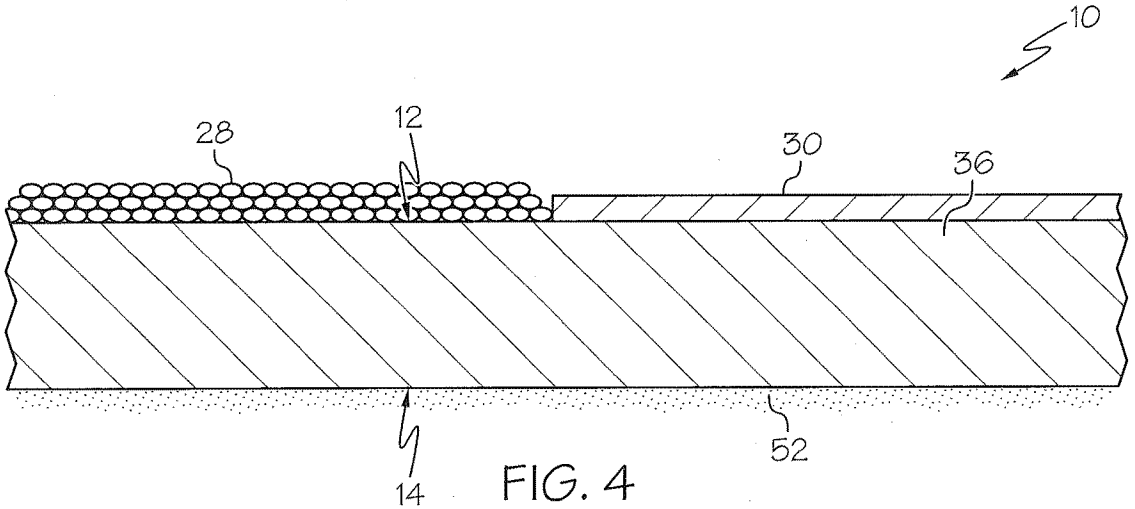
FIG. 4 is an enlarged fragmentary sectional view of a portion of the shingle of FIG. 3 encircled in balloon 4.

As illustrated in FIGS. 3 and 4, the mask or film layer 30 can be adhered to the asphalt-based coating that covers at least part of the top surface 12 of the headlap portion 26. It will be understood that the film layer 30 may cover the entire headlap portion 26 or just a part thereof. Further, in one embodiment, the film layer 30 covers only the headlap portion 26 and does not extend to or cover any part of the tab portion 24. The film layer 30 is adapted for preventing granules 28 from adhering to the headlap portion 26. The film layer 30 may be constructed of polyester, polyvinyl-chloride, polyethylene, polypropylene, vinyl, metallic foil, parchment, paper, fabric, fiberglass or any other suitable material now known or hereafter developed to which granules 28 will generally not adhere. In one embodiment, the construction of the film layer 30 may be selected to impart strength or improved performance, such as impact resistance, "wound healing" (automatic sealing in the event of puncture), water resistance or durability.

As shown in FIGS. 1 and 2, the film layer 30 may include indicia printed thereon to be used to convey information related to the shingle's 10 production, identification, quality control, installation and warranty. As further depicted in FIGS. 1 and 2, a unique identifier may be encoded into a bar code 38, a globally unique identifier (GUID), quick response (QR) code 40 or alphanumerical code 42, and printed or applied on the film layer 30. Such unique identifiers may identify the batch number, the manufacture date, manufacturing location, quality control inspector or other information used to track the production of the shingle 10. Traceability for a specific shingle 10 is possible for the first time in the art, which may be beneficial to identify the origin of a shingle 10, time and date of manufacture, or other manufacturing characteristics. It may also allow mapping between an installed shingle 10 (location and positional information as installed) and manufacturing characteristics relevant to time and space. The film layer 30 may further include the manufacturer's name 44, installation instructions 46, warnings, warranty information 48, marketing information 50, one or more laying lines 54 or other guide marks 56 that assist in installation.

Granules 28, such as ceramic or mineral granules, are applied to at least a part of the tab portion 24. The granules 28 are generally adhered to the exposed asphalt-based coating that has been applied to the tab portion 24. As set forth above however, in one preferred embodiment, none or substantially none of the granules 28 will adhere or stick to the film layer 30 covering the headlap portion 26. The granules 28 may be a colored blend of granules or may be of a single color. As depicted in FIGS. 3 and 4, the shingle 10 may optionally include a layer of fine granules 52 adhered to bottom surface 14 of the base mat 36 to prevent multiple shingles 10 from sticking together.

Turning attention now to the method of manufacture, an asphalt-based coating is applied to at least a top surface of the base mat 36 material. As is known in the art, the base mat 36 material may be supplied from a roll on a generally continuous basis. Upon application of the asphalt-based coating, the mask or film layer 30 can be adhered to the asphalt-based coating covering at least part of the top surface of the headlap portion 26. In a preferred embodiment, the film layer 30 is applied to the headlap portion 26 immediately after the asphalt-based coating is applied and is still relatively warm.

Like the base mat 36 material, the film 30 can also be supplied from a roll on a generally continuous basis. It will be understood that the film layer 30 may cover the entire headlap portion 26 or just a part thereof. Further, in one embodiment, the film layer 30 covers only the headlap portion 26 and does not extend to or cover any part of the tab portion 24. The film 30 may be cut to the width and length of the headlap portion 26 prior to being applied or after being applied.

Once the film layer 30 is applied to the headlap portion 26, the granules 28 may be applied to at least the top surface of the base mat 36. Some of the granules 28 will adhere to the exposed asphalt-based coating that has been applied to the tab portion 24, while other of the granules 28 will not. In a preferred embodiment, none or substantially none of the granules 28 will adhere or stick to the film layer 30. As such, the film layer 30 is adapted for preventing granules 28 from becoming adhered to the headlap portion 26 of the base mat 36. The headlap portion 26 therefore remains substantially free of any granules 28 adhered thereto. Substantially all of the granules 28 that are not adhered to the tab portion 24 may be recovered and reused. As such, the unadhered granules 28 may be collected, introduced into a primary source of granules 28 and then reapplied to the tab portion 24. One embodiment includes collecting and reapplying a substantial majority of the granules 28 that do not adhere to the tab portion 26, while other embodiments include collecting and reapplying substantially all and even up to 100% of such granules 28.

A primary advantage of the shingle 10 and method of the present invention involves a significant cost reduction in the manufacturing of the shingle 10. No headlap granules are utilized and up to 100% of the backfall tab granules can be recovered and reapplied to the tab portion 24 of another shingle 10, as they are not "contaminated" by headlap granules of a different color or quality.

Another advantage involves a reduction in weight of the shingle 10 due to the lack of (or reduction of, as the case may be) granules applied to the headlap portion 26. Because of this reduction in weight, the weight per bundle of shingles 10 may be decreased by approximately 20 pounds to 30 pounds, which results in a bundle that is easier and safer to load onto a roof during installation, reduces freight and shipping costs, and permits more bundles of shingles 10 to be transported via truck or rail thereby improving transportation efficiency. The number of bundles per pallet may also be increased which also improves storage and transportation efficiency. Furthermore, the reduced weight may decrease the load as installed onto the roof thereby reducing the possibility of structural failures due to snow load or overloading scenarios. Another benefit of the shingle 10 of the present invention may be the reduction in complaints from installers relating to sharp granules cutting or breaking their skin or gloves because the installers can now hold the masked area and not a granulated area.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A method of manufacturing and installing roofing shingles, said method comprising the steps of:
- manufacturing one or more shingles comprising the following steps;
  - coating at least a top surface of a base mat with an asphalt material to form an asphalt-coated sheet, the asphalt-coated sheet having a tab portion and a headlap portion;
  - applying a film to at least part of said headlap portion of said asphalt-coated sheet, said film layer having a unique identifier printed on the film; and
  - associating the unique identifier to at least one of a batch number, a manufacture date, a manufacturing location, or another item of tracking information of the manufactured shingle;
  - applying granules to said tab portion of said asphalt-coated sheet;
  - wherein said film is adapted for preventing said granules from adhering to said part of said headlap portion to which said film is applied; and
- installing said one or more shingles on a roof comprising the following steps;
  - generating a map of an installed position of said one or more shingles on the roof after installing said one or more shingles onto the roof; and
  - correlating the installed position of the one or more shingles on the roof to said unique identifier of each of said one or more shingles.

2. The method of claim 1 further comprising the step of collecting granules that do not become adhered to said tab portion.

3. The method of claim 2 further comprising the step of reapplying collected granules to said tab portion.

4. The method of claim 1 wherein the unique identifier is a globally unique identifier, a quick response (QR) code, or a bar code identifier.

5. A method for manufacturing and installing a shingle comprising the steps of:
- manufacturing one or more roofing shingles comprising the following elements;
  - a base mat having a tab portion and a headlap portion;
  - an asphalt-based coating applied to at least a top surface of said base mat;
  - a film layer adhered to the asphalt-based coating applied to said top surface of said headlap portion, wherein said film layer covers substantially the entire headlap portion of said base mat;
  - said film layer having one or more unique identifiers printed on the film layer; and
  - granules adhered to the asphalt-based coating applied to said top surface of said tab portion; and
- installing said one or more roofing shingles on a roof comprising the following steps;
- mapping an installed position of said one or more shingles on the roof after installing said one or more shingles onto the roof; and
- correlating the installed position of the one or more shingles on the roof to one or more of said one or more unique identifiers printed on said film layer.

6. The method of claim 5, wherein said one or more unique identifiers identifying at least one of a batch number, a manufacture date, a manufacturing location, a quality control inspector, or another items of tracking information of the roofing shingle.

* * * * *